US009479866B2

(12) United States Patent
Adams et al.

(10) Patent No.: US 9,479,866 B2
(45) Date of Patent: Oct. 25, 2016

(54) MICROPHONE ARRAY WITH DAISY-CHAIN SUMMATION

(75) Inventors: Robert Adams, Acton, MA (US); David Hossack, Somerville, MA (US); Benjamin Vigoda, Winchester, MA (US); Eric Nestler, Cambridge, MA (US); Mira Wilczek, Cambridge, MA (US)

(73) Assignee: Analog Devices, Inc., Norwood, MA (US)

( * ) Notice: Subject to any disclaimer, the term of this patent is extended or adjusted under 35 U.S.C. 154(b) by 400 days.

(21) Appl. No.: 13/428,496

(22) Filed: Mar. 23, 2012

(65) Prior Publication Data

US 2013/0121504 A1 May 16, 2013

Related U.S. Application Data

(60) Provisional application No. 61/559,435, filed on Nov. 14, 2011.

(51) Int. Cl.
*H04R 3/00* (2006.01)

(52) U.S. Cl.
CPC ..... *H04R 3/005* (2013.01); *H04R 2499/13* (2013.01)

(58) Field of Classification Search
CPC ..... H04R 3/00; H04R 3/02; H04R 1/406; H04R 3/005; H03F 3/181; H03G 3/00; H04M 3/56; H04M 11/00; H04N 7/15; H04N 7/147
USPC ..... 381/92, 26, 94.3, 104, 105, 106, 107, 381/108, 110, 111, 113, 174, 355, 120, 121, 381/122, 91, 86, 78, 80, 74, 320, 321, 316, 381/314, 313, 61, 302, 23.1, 119, 123; 348/E7.081, E7.083; 700/94
See application file for complete search history.

(56) References Cited

U.S. PATENT DOCUMENTS 4,485,484 A * 11/1984 Flanagan ..... H04R 1/406 381/111
4,521,908 A * 6/1985 Miyaji ..... G10K 11/346 367/905

(Continued)

FOREIGN PATENT DOCUMENTS

CN 87205199 U 10/1988
CN 101803202 A 8/2010

OTHER PUBLICATIONS

Office Action issued in CN Patent Appln. No. 201210439253.X, dated Dec. 31, 2014, 41 pages. (with EN translation).

(Continued)

*Primary Examiner* — Leshui Zhang
(74) *Attorney, Agent, or Firm* — Schwegman Lundberg & Woessner, P.A.

(57) ABSTRACT

Microphone stages in a microphone array may be coupled together in a daisy chain. Each stage may include a microphone, an analog to digital converter, a decimation unit, a receiver, an adder, and a transmitter. The converter may convert analog audio microphone signals into digital codes that may be decimated. The adder may add decimated digital codes in each stage to a cumulative sum of decimated digital codes from prior stages. This new sum may be transmitted to the next microphone stage, where the adder may add the decimated digital codes from that stage to the cumulative sum. A serial interface may be used to connect the transmitters and receivers of each of the stages. The serial interface may be used to transmit the cumulative sum of decimated digital codes between the stages. The serial interface may also be used to transmit configuration data between the stages.

63 Claims, 11 Drawing Sheets

(56) References Cited

U.S. PATENT DOCUMENTS 5,740,256 A * 4/1998 Castello Da Costa ..... H04B 7/015 381/94.7
6,421,443 B1 * 7/2002 Moore ..... G06J 1/00 379/390.01
6,430,294 B1 * 8/2002 Fujita ..... H04S 1/002 381/17
7,146,012 B1 * 12/2006 Belt ..... G10K 15/00 381/92
7,174,229 B1 * 2/2007 Chen ..... H04S 3/008 700/94
7,365,669 B1 4/2008 Melanson
7,460,677 B1 * 12/2008 Soede ..... H04R 25/407 381/122
7,474,753 B2 * 1/2009 Araya ..... G10K 15/12 381/61
8,184,801 B1 * 5/2012 Hamalainen ..... H04M 9/08 379/406.09
2003/0169890 A1 * 9/2003 Arvidsson ..... H04R 3/005 381/92
2004/0013038 A1 * 1/2004 Kajala ..... G01S 3/043 367/119
2004/0105557 A1 * 6/2004 Matsuo ..... H04R 3/005 381/92
2006/0002456 A1 * 1/2006 Wagner ..... H04M 11/066 375/222
2006/0104457 A1 * 5/2006 Kawaguchi ..... H04N 7/147 381/91
2007/0047742 A1 * 3/2007 Taenzer ..... H04R 3/005 381/92
2008/0285770 A1 * 11/2008 Wu ..... H04R 1/406 381/92
2010/0278358 A1 * 11/2010 Pocino ..... H04M 3/561 381/119
2012/0070004 A1 * 3/2012 LaBosco ..... H04H 20/30 381/2
2012/0114159 A1 * 5/2012 Akino ..... H04R 1/406 381/369
2012/0155666 A1 * 6/2012 Nair ..... G10K 11/178 381/71.6
2013/0077805 A1 * 3/2013 Kirsch ..... G11B 27/105 381/119

OTHER PUBLICATIONS

"Chinese Application Serial No. 201210439253.X, Office Action mailed Feb. 23, 2016", (English Summary), 1 pg.
"Chinese Application Serial No. 201210439253.X, Office Action mailed Sep. 6, 2015", (w/ English Translation), 9 pgs.
"Chinese Application Serial No. 201210439253.X, Response filed May 3, 2016 to Office Action mailed Feb. 23, 2016", (w/ English Translation of Claims), 22 pgs.
"Chinese Application Serial No. 201210439253.X, Response filed May 15, 2015 to Office Action mailed Dec. 31, 2014", (w/ English Translation of Amended Claims), 22 pgs.
"Chinese Application Serial No. 201210439253.X, Response filed Nov. 6, 2015 to Office Action mailed Sep. 6, 2015", (w/ English Translation of Claims), 8 pgs.

* cited by examiner

MICROPHONE ARRAY WITH DAISY-CHAIN SUMMATION

CROSS-REFERENCE TO RELATED APPLICATIONS

This application claims the benefit, under 35 U.S.C. §119(e), of U.S. Provisional Patent Application No. 61/559,435, filed Nov. 14, 2011, the contents of which is hereby incorporated by reference in its entirety.

BACKGROUND

Microphone arrays have been used to improve fidelity and reduce effects of ambient noise. Arrays of two or more microphones may be used to capture specific audio signals while reducing the effects of background noise and other undesirable sounds. Various beamforming algorithms may be used to combine the signals from each of the microphones in the array so that audio signals originating from a particular direction constructively interfere and generate a highest magnitude response over audio signals originating from other directions.

These beamforming algorithms were originally implemented in signal processing devices, which required each of the microphones to be individually wired to separate inputs of the signal processing device, typically an integrated circuit. The number of wires therefore increases proportionally with the number of microphones in the array. Incorporating these extra wires requires additional expense and space in the device. Additionally, the extra wires may affect the overall reliability of the system as the likelihood of a defect, malfunction, or problem with one or more of the wire sets tends to increases as the number of wires increases.

The inventors perceive a need for a microphone array supporting a large number of microphones with a limited number of connecting wires.

DETAILED DESCRIPTION

Figure 1:
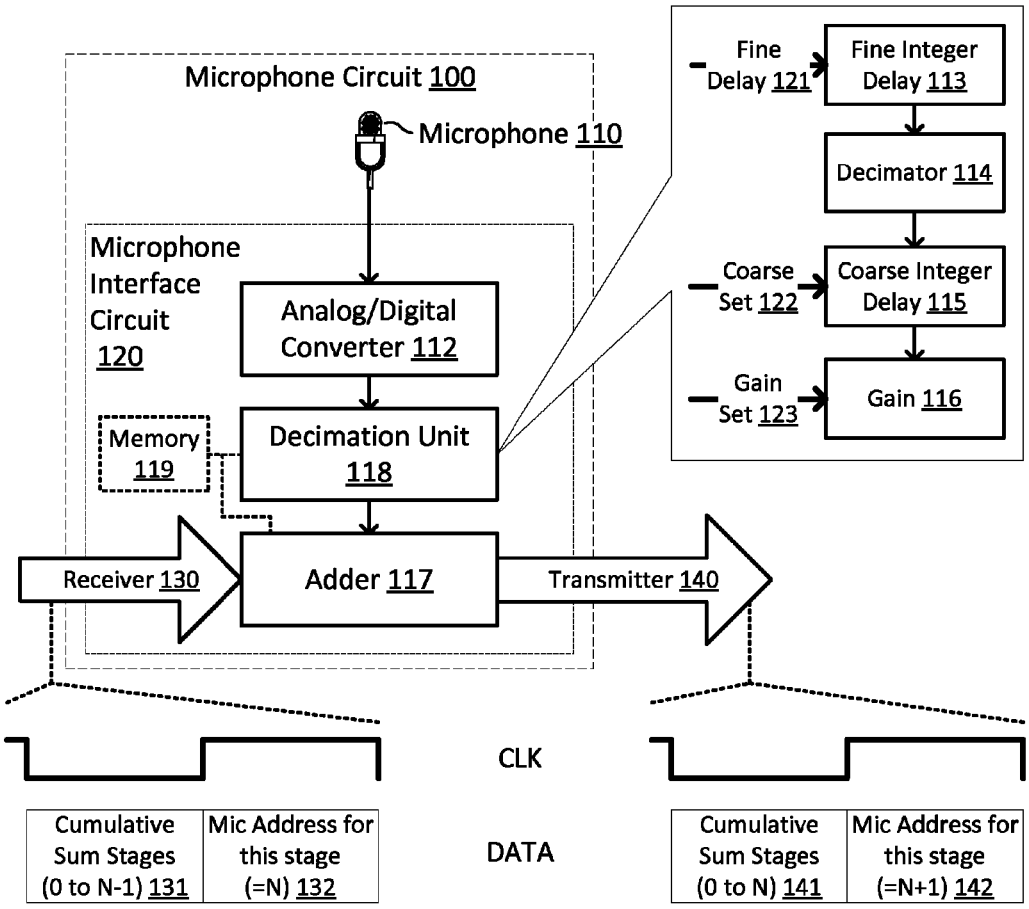
FIG. 1 shows an exemplary block diagram of an embodiment.

Embodiments of the invention provide a system having an array of microphone stages in which each of the microphone stages may be coupled together in a daisy chain. Each microphone stage may include a microphone, an analog to digital converter, a decimation unit, a receiver, an adder, and a transmitter. The analog to digital converter may convert sampled audio signals from the microphone into digital codes. The decimation unit may decimate digital codes from the analog to digital converter output to an audio frame rate of a serial interface used to transmit data between microphone stages. The decimation unit may also include a delay unit to implement a delay at each microphone stage.

The transmitter in the first microphone stage may transmit the output of the decimation unit to the receiver of the second microphone stage in the array. The adder in the second microphone stage may add the transmitted digital codes from the first stage to the output of the decimation unit in the second microphone stage. The transmitter in the second microphone stage may then transmit the sum of these digital codes from the adder to the receiver in the third microphone stage, where the adder in the third microphone stage may add the summed digital codes from the second microphone stage to the output of the decimation unit in the third microphone stage, and so on.

Since each stage may add its audio codes to the cumulative sum of digital audio codes from the prior stages, a smaller and fixed amount of bandwidth may be allocated to the transmission of audio data than if each microphone stage were to transmit its audio data to a final device in a separate channel.

A microphone circuit stage in a daisy chained microphone array may include a microphone, an analog to digital converter coupled to the microphone, a decimation unit coupled to the analog to digital converter, a first input of an adder coupled to the decimation unit, a receiver coupled to a second input of the adder, and a transmitter coupled to an output of the adder.

A serial data stream may be used to transmit audio data and configuration data between the transmitters and receivers in each of the microphone stages. The audio data that is transmitted may represent a cumulative sum of sampled audio data obtained from each of the microphones at prior microphone stages in the daisy chain. At each microphone stage, the audio data obtained from the microphone may be added to the sum of the audio data at the prior stages and this sum may replace the audio data being transmitted over the serial data stream.

The configuration data may include microphone address assignment data to assign an address to microphone in the array, delay data to set a variable delay associated with one or more microphones in the array, gain data to set a variable gain associated with one or more microphones in the array and/or other configuration settings pertaining to the microphone array. In some instances, the delay data and gain data may be transmitted over a separate channel than the audio data and address assignment data.

Each delay unit may have a delay selected to insure that the audio data from its associated microphone corresponding to sound from a particular direction is time-aligned with the data represented by the cumulative sum arriving at the receiver of that microphone stage. To achieve precise control over the steering direction, the delay at each microphone node may need to be adjusted in finer steps than can be accomplished by using an integer number of sample-periods, and therefore it may be necessary to set both an integer as well as a fractional delay amount. In these conditions it is possible to use the higher frequency clock rates used in the oversampling analog-to-digital converters to implement the fractional part of the delay, and the integer part of the delay can be implemented at the lower sample rates that correspond to the audio frame rate. The integer and the fractional delays can be set using the configuration channel transmitted to each microphone.

FIG. 1 shows an exemplary block diagram of a microphone circuit 100 in an embodiment of the invention. A microphone 110 may be coupled to a microphone interface circuit 120, which may include a preamplifier (not shown) to initially boost an analog signal from the microphone, an analog to digital converter 112, decimation unit 118, and adder 117. The microphone and/or preamplifier may be coupled to an analog to digital converter 112 that may generate digital code words from the analog audio signal obtained from the microphone 110.

The analog digital converter 112 may oversample the analog audio signal at higher frequencies, such as 2.4 MHz or higher in some embodiments, than are used to transmit the serial audio data between microphone circuits 100 in the microphone array, which may transmit data at 44 kHz.

A decimation unit 118 may be coupled to the converter 112 and may decimate the digital code words generated at the converter 112. In some instances, the decimation unit 118 may decimate the digital code words by first filtering or otherwise transforming the ADC output codes before downsampling the codes. In other instances, the decimation unit 118 may decimate the digital code words by directly downsampling the ADC output codes. The decimation unit 118 may include a delay unit with one or more delay elements 113 and/or 115 that may implement a delay using memory or storage units at various locations within the structure of the decimation filter to ensure that the output codes from the decimation unit 118 align with the decimated code words at the other microphone stages from audio signals received at different times at each of the other microphones.

In an embodiment, the decimation unit 118 may include a fine integer delay element 113, a coarse integer delay element 115, a decimator 114, and/or a gain 116.

A fine variable integer delay 113 may be coupled to the analog to digital converter 112. The fine variable integer delay 113 may include a fine delay input 121, which may be used to select a whole number of cycles at the higher frequency of the analog to digital converter 112 to delay the generated digital code words outputted by the converter 112. Since the analog to digital converter 112 may operate at frequencies many times higher than the serial data stream, the fine variable integer delay 113 may enable the selection of a precise delay amount to maximize alignment of the audio signals received at different times at each microphone in the microphone array.

A decimator 114 may be coupled to the output of the fine variable integer delay 113. The decimator 114 may be used to reduce the sampling rate of the digital code words outputted by the converter 112 so that the remaining digital code words correspond to the serial data stream frame rate.

A coarse variable integer delay 115 may be coupled to the output of the decimator 114. The coarse variable integer delay 115 may include a coarse delay input 122, which may be used to select a whole number of clock cycles of the serial data stream frame clock to delay the decimated code words.

A variable gain 116 may be coupled to the output of the coarse variable integer delay 122. The variable gain 116 may include a gain set input 123, which may be used to specify the magnitude of gain applied to the delayed output of the decimator 114.

An adder 117 may be coupled to the output of the decimation unit 118. The adder 117 may add the output of the decimation unit 118 to a cumulative sum 131 of prior microphone circuit stages 0 to N−1 (assuming the microphone stage 100 in FIG. 1 is the Nth stage) that is received 130 at the data stream input. After the adder 117 adds the output of the decimation unit 118 to the cumulative sum 131, the resulting sum may then be transmitted 140 as a new cumulative sum 141 of microphone stages 0 to N to the next microphone stage N+1. Thus, each microphone stage in the microphone array may add its output code to that of the prior stages to eventually create a single cumulative beamformed output code. The receiver 130 may include a serial-to-parallel converter, not shown, and likewise the transmitter 140 may include a parallel-to-serial converter, also not shown.

In addition to the cumulative audio data 131 and 141 that may be received 130 and transmitted 140 over a serial data stream, certain configuration data may also be transmitted. In this example, a microphone address may be assigned to each microphone stage 100 in the daisy chain as part of the configuration data. A first microphone circuit in the microphone array may be assigned address '00001', which may be transmitted as part of the serial data stream input to the first microphone circuit. The first microphone circuit may then store its assigned address in a memory 119 and its adder circuitry may then add a '1' to the address and output the new address '00010', which may be assigned to the next microphone circuit in the array and so on. Thus, the microphone circuit at stage N may be assigned address N 132. Its adder 117 may add a '1' to the address N and a microphone address N+1 142 to be assigned to the next microphone stage may be transmitted 140 to the next stage.

In the embodiment shown in FIG. 1, half of one serial data stream clock cycle may be used to transmit the audio data 131 and 141 and the other half clock cycle may be used to transmit the configuration data, such as the microphone address assignment data 132 and 142. In other embodiments, the clock cycles may be divided differently. For example, in some embodiments, additional, less, different, or even no configuration data may be transmitted during a clock cycle.

In some embodiments, the fine delay 121, coarse delay 122, and gain set 123 inputs in each microphone circuit 100 may be pre-configured before the microphone array is used. During the pre-configuration, each circuit 100 may be supplied with predetermined input values that have been optimized based on the intended use of the microphone array. In other embodiments, these inputs 121, 122, and 123 may be dynamically configured. In some instances this configuration data may be stored in a memory 119.

An Integrated Interchip Sound protocol (I2S) may be used to transmit, encode, decode, and process audio data in the serial data stream. Other protocols may also be used in other embodiments.

Each of the components shown in FIG. 1, other than the microphone 110, may be fabricated in a common integrated circuit.

Figure 2:
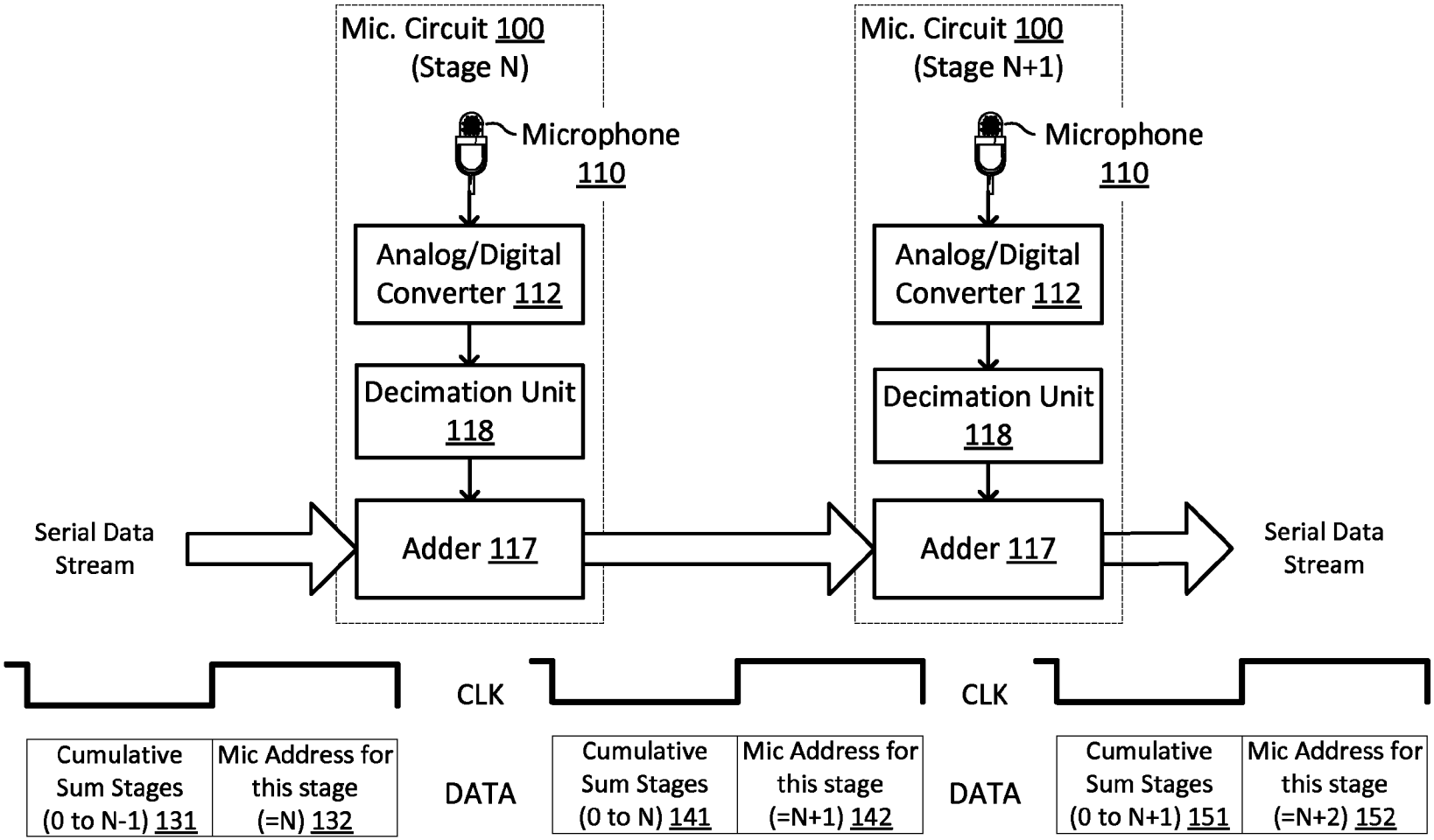
FIG. 2 shows an exemplary daisy chaining of two microphone circuits in a microphone array.

FIG. 2 shows an exemplary daisy chaining of two microphone circuits 100 in a microphone array. In this example, each of the microphone circuits may be linearly connected to the same serial data stream. The left most microphone circuit 100 may be at microphone circuit stage N in the array while the right most circuit may be at stage N+1 in the array.

As shown in this figure, a serial data stream input to the stage N circuit 100 may include cumulative audio data 131 representing the sum of digital audio codes from the prior stages (0 to N−1). The serial data stream input may also include a microphone address assignment to address N 132.

The adder 117 in the stage N circuit 100 may then add the output digital audio code originating from the stage N microphone 110 to the cumulative sum from stages 0 to N−1 131 to create a new cumulative sum for stage 0 to N 141, which may be outputted to the next N+1 microphone stage 100.

The adder 117 in the stage N circuit 100 may also add 1 to the assigned microphone address N 132 and output a new assigned microphone address N+1 142 that may be sent to the next N+1 stage circuit 100.

The adder 117 in the stage N+1 circuit 100 may then add the output digital audio code originating from the stage N+1 microphone 110 to the cumulative sum of stages 0 to N 141 outputted by the stage N circuit 100 to create a new cumulative sum for stage 0 to N+1 151, which may be outputted 140 to the next N+2 microphone stage 100.

The adder 117 in the stage N+1 circuit 100 may also add 1 to its assigned microphone address N+1 142 and output a new assigned microphone address N+2 152 that may be sent to the next N+2 stage circuit 100.

Figure 3:
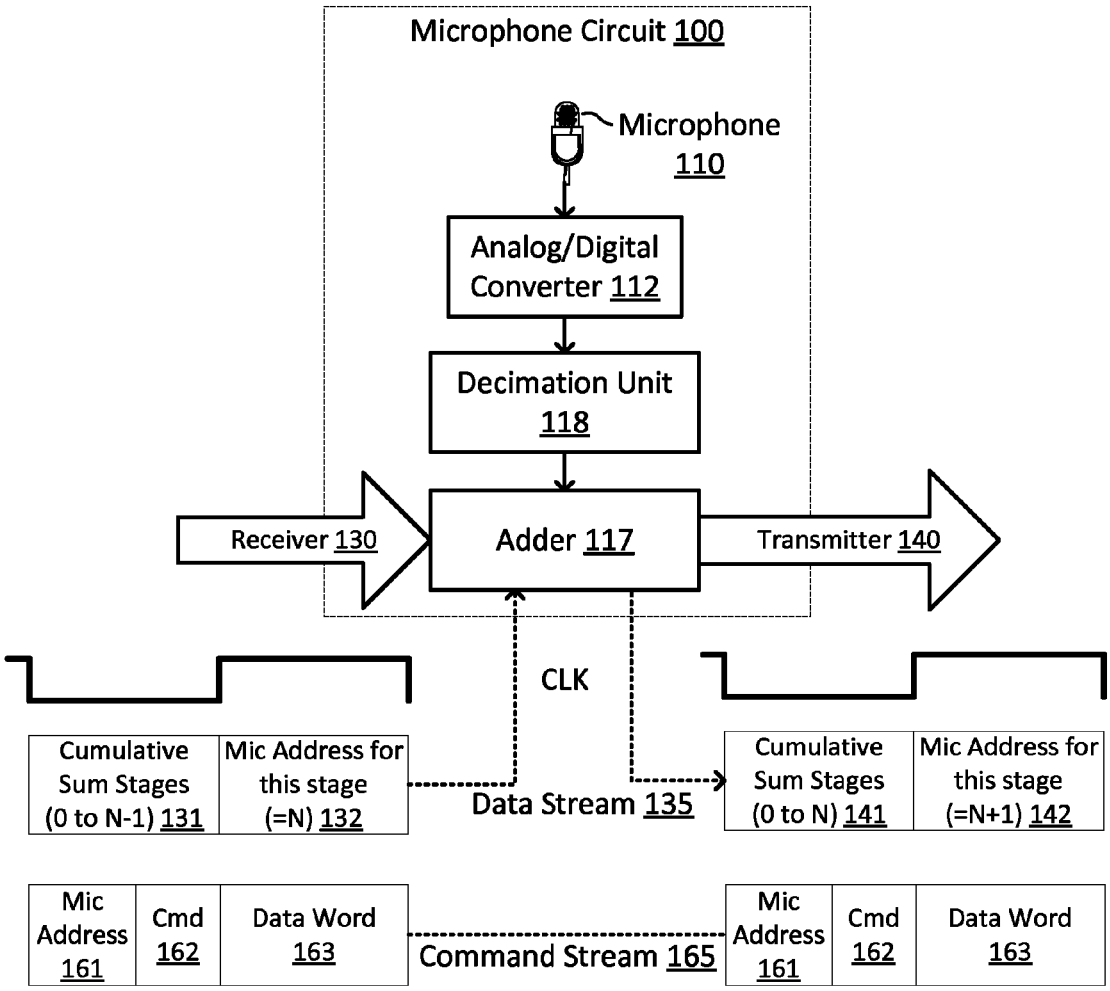
FIG. 3 shows an exemplary embodiment in which two separate channels of data are transmitted to each microphone circuit.

FIG. 3 shows an exemplary embodiment in which two separate channels of data are transmitted to each microphone circuit 100. In some embodiments, each channel may be serially transmitted over different wires. The two channels may include a data stream channel 135 and a command stream channel 165.

The data stream channel 135 may be used to transmit the cumulative sum of audio data 131 and 141 from each microphone circuit 100 as well as microphone circuit address assignment data 132 and 142 to assign unique addresses to each microphone circuit 100 in the array.

The command stream channel 165 may be used to transmit configuration data and commands to each of the microphone circuits 100 in the array. The packets transmitted over the command stream channel 165 may be formatted to include a microphone address 161, a command code word 162, and a data word 163.

The microphone address 161 may specify the assigned address of the microphone circuit 100 for which the corresponding command code word 162 and data word 163 is intended.

The command code word 162 may specify a command that the addressed microphone circuit 161 is to execute. These commands may specify instructions such as setting a digital delay 118, setting a gain, bypassing a microphone circuit, muting a microphone, or setting an analog preamplifier gain.

The data word 163 may specify a value associated with the command code word 162. For example, the value specified in data word 163 may be an amount of delay or gain that is to be set.

Each microphone circuit 100 may passively listen to the packets transmitted over the command stream. When a microphone circuit 100 identifies packets having a microphone address 161 corresponding to its assigned microphone address 132, the microphone circuit 100 may then execute the command 162 and apply or set the value specified in the data word 163. Each microphone may also passively listen for packets that contain an address that is designated as a "global broadcast" address. When such an address is transmitted, all microphones receive the same command at the same time.

In some embodiments, the amount of delay to be applied may be calculated in advance and then encoded into the data words 163 associated with respective set delay commands 162 for each microphone address 161. For example, if a microphone array has a total length of 3 feet, sound may arrive at the first microphone at the beginning of the array approximately 3 ms before arriving at the last microphone at the end of a linear array (assuming sound travels at roughly 1 ms/ft). In the case of a decimated sample rate of 44.1 KHz, a one sample delay would last approximately 22 μs. To obtain the 3 ms delay, a delay of 136 sample cycles would be needed (3 ms/22 μs). Thus, the data word 163 may be set to '10001000' (corresponding to the decimal number 136), to specify a delay value of 136 cycles associated with the set delay command 162 for the last microphone in the array.

In some instances buffering the cumulative audio data 131 from prior stages in order to perform the addition at adder 117 may cause an additional delay in each node. In these instances the programmed delay may be adjusted to account for this delay. For example, if a one sample delay per stage is caused by the buffering of the cumulative data, a corresponding sample offset could be subtracted from the programmed delay depending on the position of the stage in the array.

Figure 4:
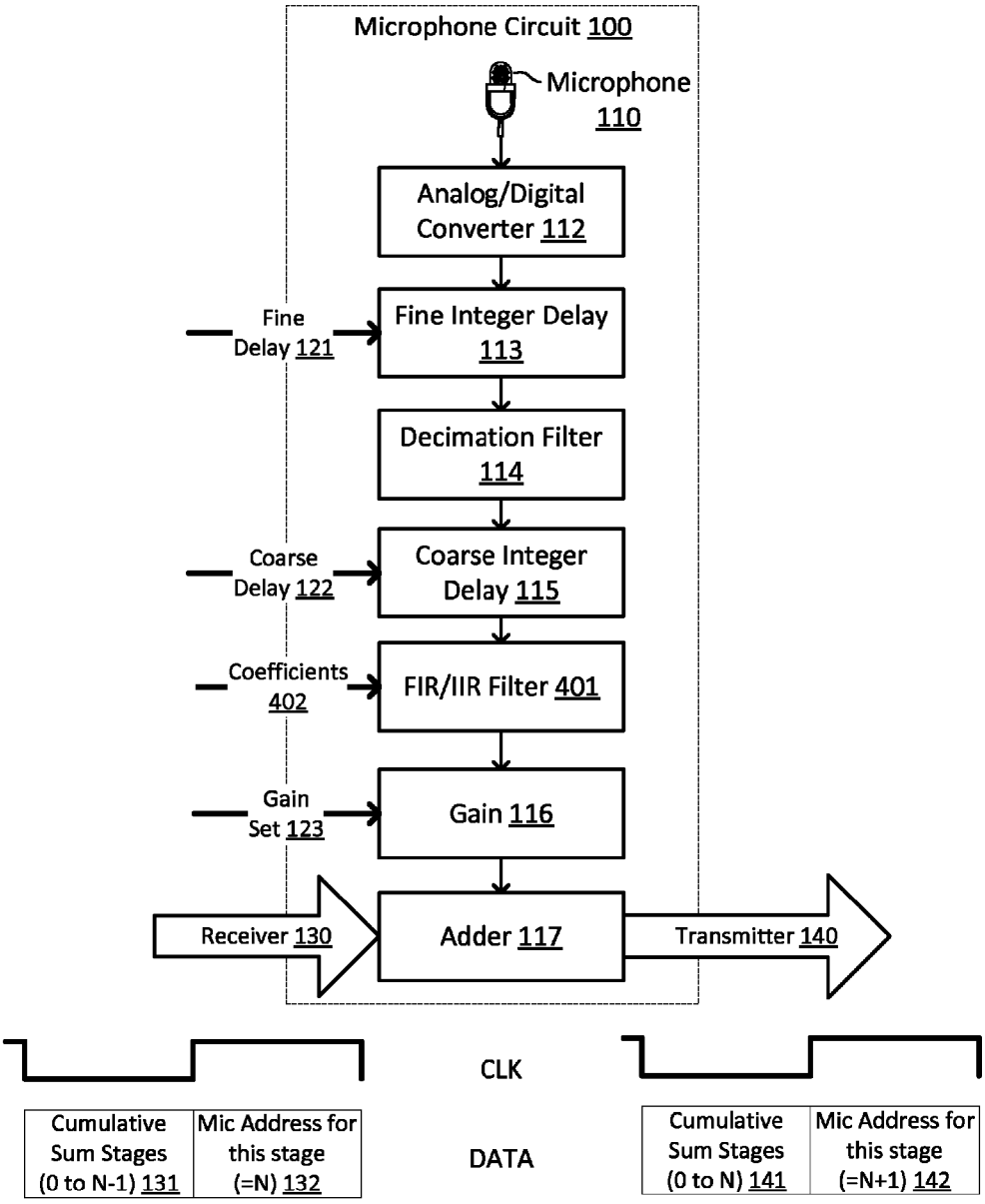
FIG. 4 shows an exemplary embodiment including a filter.

FIG. 4 shows an exemplary embodiment in which a finite impulse response (FIR) or infinite impulse response (IIR) filter 401 may be coupled between a coarse integer delay element 115 and a gain 116 in the decimation unit 118 to filter the decimated output from a decimation filter 114. The FIR/IIR filter 401 may be configured with a set of coefficients 402 or tap weights that specify the relative weight assigned to each of the prior digital codes outputted at the decimator 114. These coefficients may be uploaded to the microphone circuits 100, such as through the use of commands 162 and data word 163 in the command stream 165. Other uploading techniques may also be used and in some instances, each filter 401 may be preconfigured with a predetermined set of coefficients.

Adding a FIR/IIR filter 401 may enable more precise control over the resulting beamforming output pattern though the use of customizable weighted sums of audio output codes from prior microphone stages instead of a simple sum. The FIR/IIR filter 401 may also enable customized control of the frequency response and related dynamics of each microphone circuit 100, as well as enabling the use of adaptive nulls in the beamforming output pattern.

Figure 5:
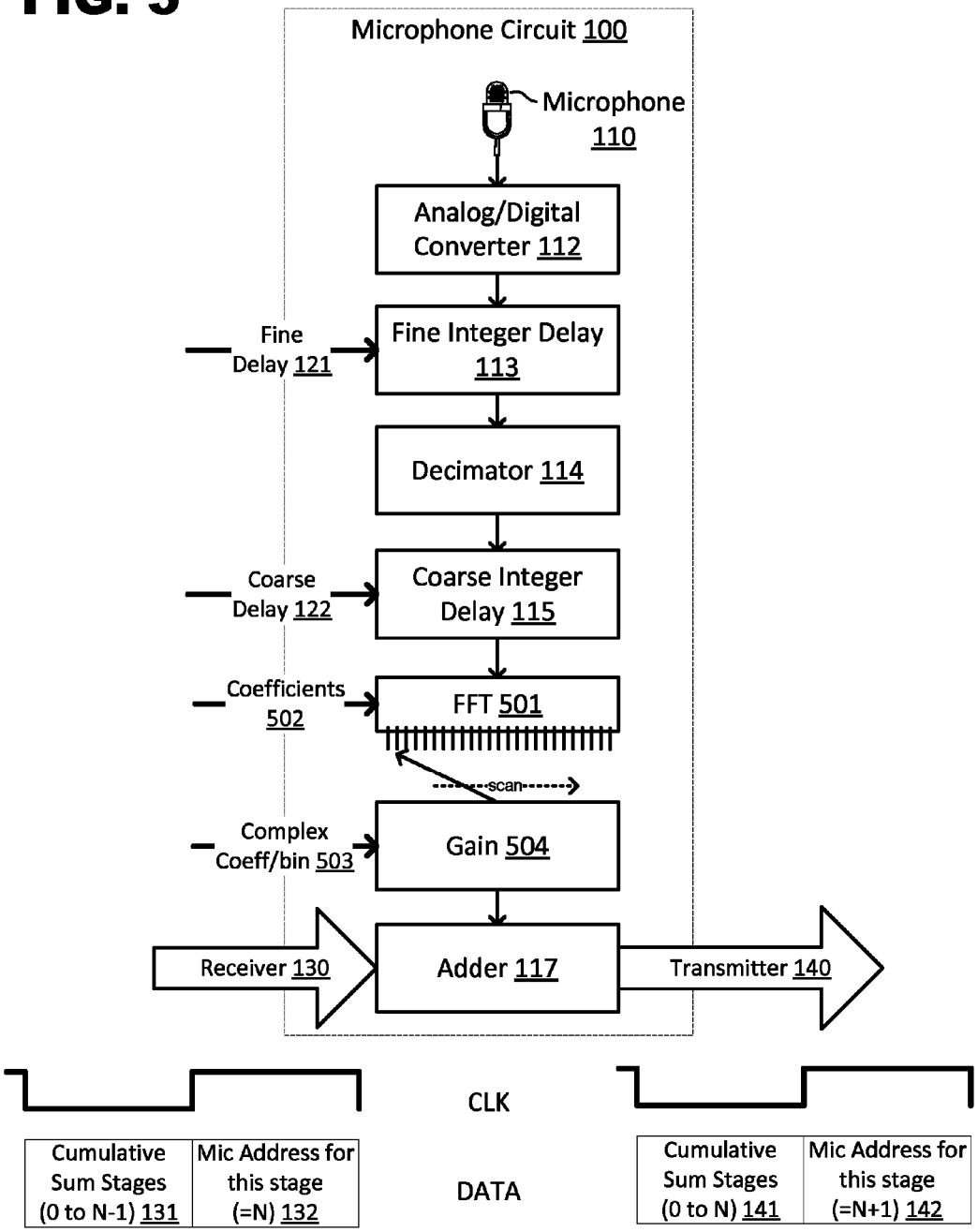
FIG. 5 shows an exemplary embodiment including a fast Fourier transform (FFT) circuit.

FIG. 5 shows an exemplary embodiment in which a fast Fourier transform (FFT) circuit 501 may be coupled between a coarse integer delay element 115 and a gain 116 in decimation unit 118 to filter the decimated output from the decimator 114.

The FFT circuit 501 may be configured with a set of coefficients 502. The gain 504 may be configured with a corresponding binary set of complex coefficients 503. With FFT circuit 501, the serial data stream 130 and 140 may correspond to a serial scan of some or all of the FFT outputs. Each output from the FFT circuit 501 may include a real and imaginary component. These outputs may be added 117 to a corresponding cumulative sum 131 of similar outputs from the prior stages (0 to N−1). The result of each of these additions at adder 117 may then be outputted 140 and sent to the next microphone stage.

Since each of the FFT outputs are complex, additional bandwidth may be needed over the previously mentioned embodiments that include outputs with only a real component. Additionally, since each of the outputs are individually combined to create the cumulative sum, some data frame may be overlapped which may also require additional bandwidth.

Each of the complex coefficients may be used to implement a complex rotation of the output codes from FFT circuit 501 at the gain 504. Additionally, the use of the FFT circuit 501 may require additional bandwidth to output the different components. These coefficients may be uploaded to the microphone circuits 100, such as through the use of commands 162 and data word 163 in the command stream 165. Other uploading techniques may also be used and in some instances, each filter 401 may be preconfigured with a predetermined set of coefficients.

Figure 6:
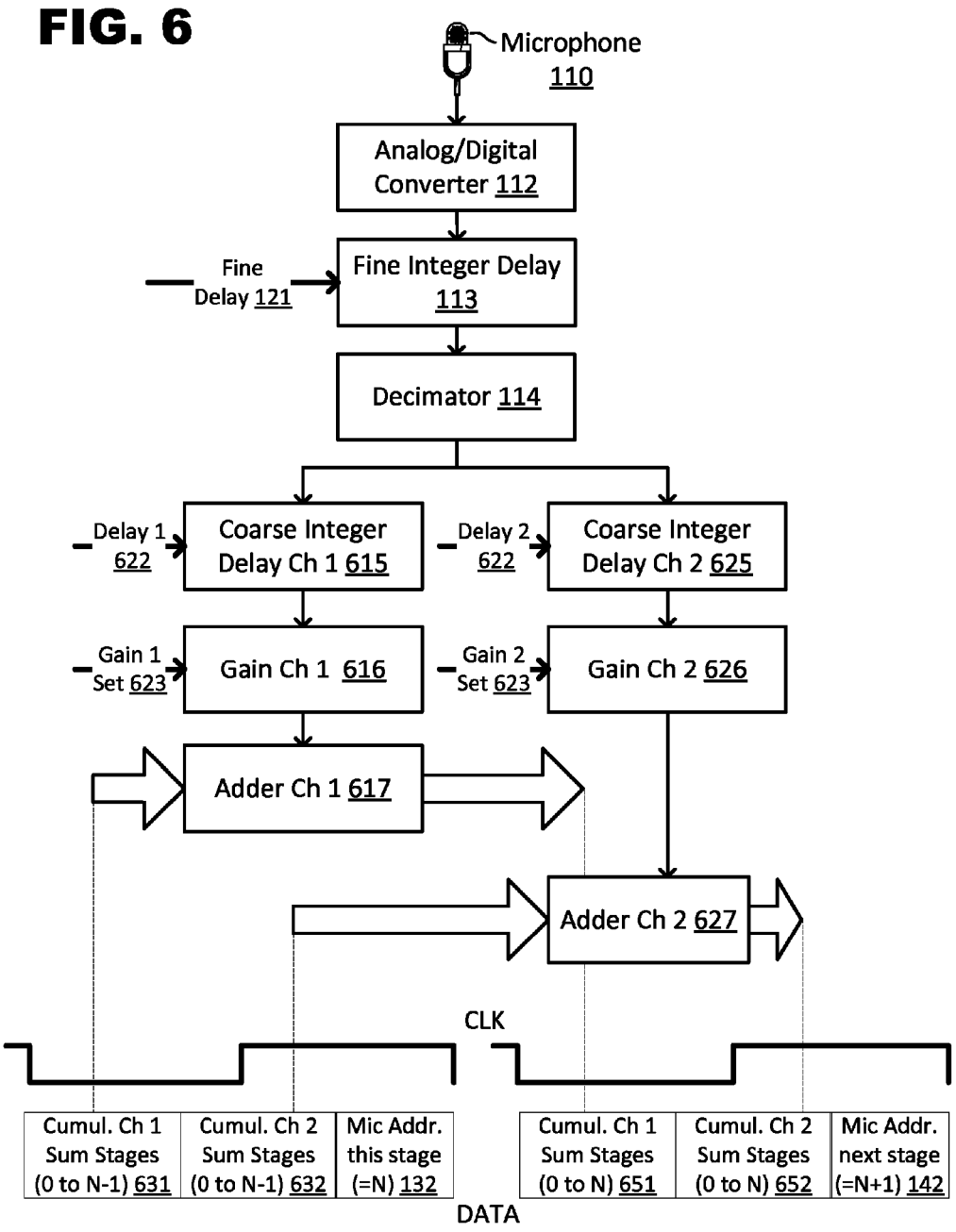
FIG. 6 shows an exemplary block diagram of a microphone circuit in a multi-channel audio embodiment.

FIG. 6 shows an exemplary block diagram of a microphone circuit 100 in a multi-channel audio embodiment of the invention. The microphone 110 may be coupled to a preamplifier (not shown) to initially boost analog signals from the microphone. The preamplifier, if used, may be coupled to an analog to digital converter 112 that may generate digital code words from the amplified analog audio signal obtained from the microphone 110.

The analog to digital converter 112 may oversample the analog audio signal at higher frequencies, such as 2.8 MHz or higher in some embodiments, than are used to transmit the serial audio data between microphone circuits 100 in the microphone array, which may transmit data in each channel at 44 kHz. A fine variable integer delay unit 113 may be coupled to the converter 112 to delay the digital output from the converter 112 an integer number of converter clock cycles.

A decimator 114 may be coupled to the output of the fine integer variable delay 113. The decimator 114 may be used to reduce the sample-rate of the digital code words outputted by the converter 112 to equal the sample-rate of the serial data stream frame-clock rate.

The output from the decimator 114 may be coupled to circuits associated with two or more separate channels. For example, coarse integer variable delay circuits 615 and 625 may be coupled to the output of the decimator 114. Each of these delay circuits 615 and 625 may include individually configurable delay inputs 622, which may be used to select a whole number of clock cycles of the serial data stream 130 to delay the decimated code words. In some instances, the selected delay at the coarse integer delay circuit 615 associated with the decimated code words intended for a first channel may be different than that selected for the coarse integer delay circuit 625 associated with a second channel.

Separate variable gains 616 and 626 may be coupled to the respective outputs of the coarse integer variable delay circuits 615 and 625. Each variable gain 616 and 626 may include a gain set input 623, which may be used to individually configure the magnitude of gain applied to the delayed output of the decimator 114 associated with each channel.

Separate adders 617 and 627 may be coupled to the respective outputs of variable gains 616 and 626. Each adder 617 and 627 may add the output from its respective variable gain 616 and 626 to a respective cumulative sum 631 and 632 of prior microphone circuit stages 0 to N−1 (assuming the microphone stage 100 in FIG. 6 is the Nth stage) in each respective channel that is received at the serial data stream input.

After the adders 617 and 627 add the output of their respective variable gains 616 and 626 to the respective cumulative sums 631 and 632 of their respective channels, the resulting sum may then be outputted as respective new cumulative sums 651 and 652 of microphone stages 0 to N on each respective channel. These new cumulative sums may then be transmitted to the next microphone stage N+1. Thus, each microphone stage in the microphone array may add its output code of each channel to that of the prior stages to eventually create a single cumulative beamformed output code for each channel.

Figure 7:
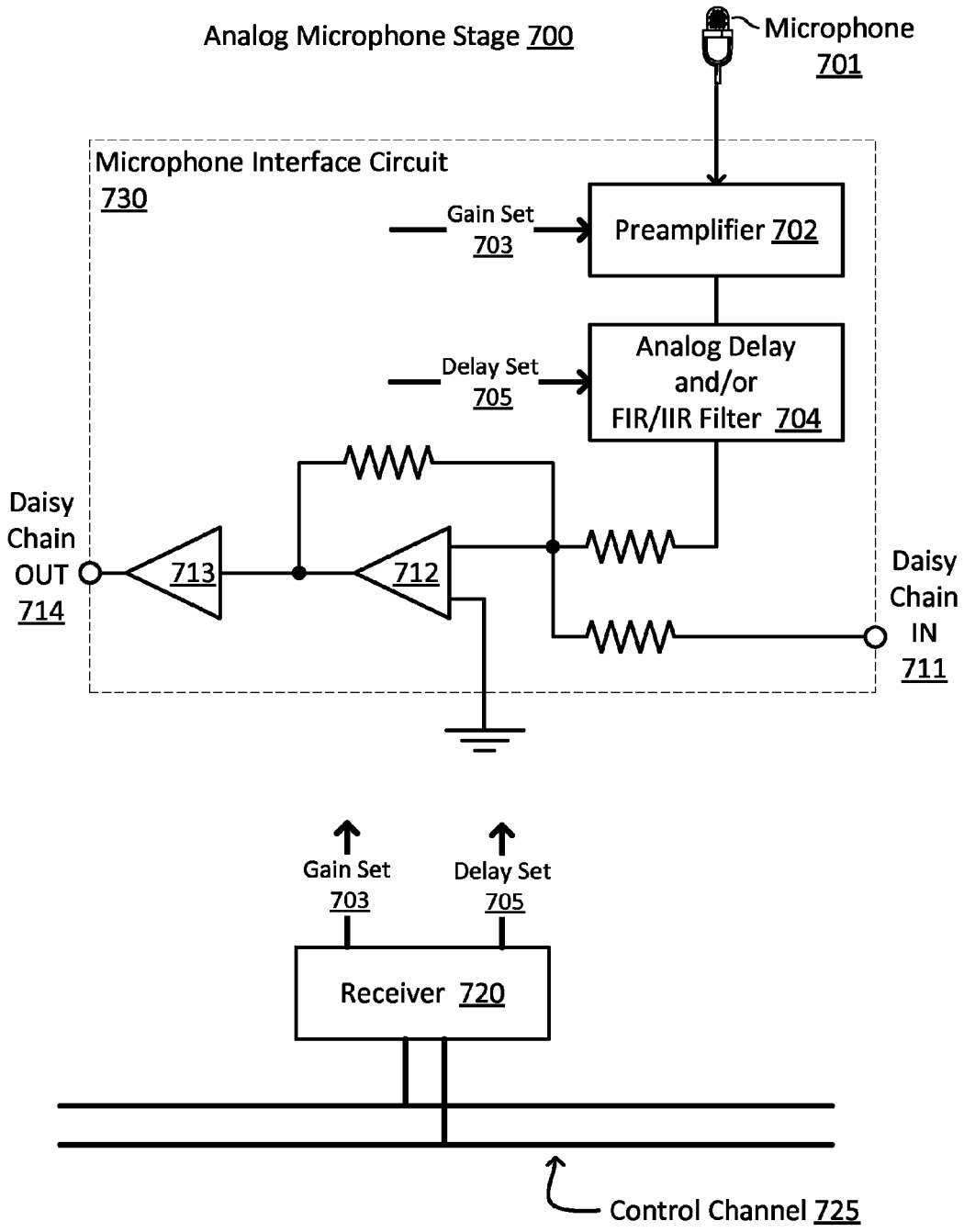
FIG. 7 shows an exemplary block diagram of an analog microphone stage circuit.

FIG. 7 shows an exemplary block diagram of an analog microphone stage circuit 700 in an embodiment of the invention. An analog microphone 701 may be coupled to a microphone interface circuit 730. The microphone interface circuit 730 may include a preamplifier 702, an analog delay/filter circuit 704, amplifiers 712 and 713, daisy chain input 711, and daisy chain output 712.

The preamplifier 702 may initially boost analog signals from the microphone 701. The preamplifier 702 may be coupled to the analog delay and/or filter circuit 704. The preamplifier 702 may be supplied with a gain set input 703 which may be used to specify an amount of gain to be applied to the analog output signals from the microphone 701.

The analog delay/filter circuit 704 may include an analog delay, a finite impulse response (FIR) filter, an infinite impulse response (IIR) filter, or both a delay and a filter. The analog delay, if included, may have a switched capacitor or charge-coupled-device (CCD) analog delay line. The switched capacitors in the analog delay may also be used to perform the analog summing at amplifiers 712 and/or 713, which may save power in some instances. The analog delay 704 may be supplied with a delay set input 705 which may be used to specify the capacitors to be switched in the delay line to obtain a desired delay. The analog delay 704 may also have an analog equivalent architecture to that shown in FIG. 4, such as by including an analog filters including FIR, IIR, and fractional delay filters. In these instances, an analog to digital converter may then be operated at lower rates used to transmit data over the serial data stream.

The output of the delay circuit 704 may be coupled to a first input of an amplifier 712. A resistor may be coupled between the output of the delay circuit 704 and the amplifier input 712.

An input 711 to the microphone stage 700 may be coupled to the first input of amplifier 712, the output of amplifier 712, and the output of delay circuit 704. A resistor may be coupled between the input 711 to the microphone stage 700 and the first input of amplifier 712, the output of amplifier 712, and the output of delay circuit 704. Another resistor may be coupled between the first input of amplifier 712 and the output of amplifier 712.

The output of amplifier 712 may be coupled to another amplifier 713. Both these amplifiers 712 and 713 may be inverting amplifiers.

The output of amplifier 713 may be coupled to an output 714 of the microphone stage 700. This output may be coupled to an input of a next microphone stage (not shown) in the microphone array.

The coupling of stage inputs to the respective outputs of prior stages and the stage outputs to the respective inputs of subsequent stages may form the daisy chain configuration of the stages in the microphone array.

In some embodiments, each analog stage may also include a receiver 720 connected to a separate analog control channel(s) 725. The receiver 720 may monitor the control channel(s) 725 and upon detecting a gain setting 703 or delay setting 705 intended for the microphone stage 700, may supply the detect gain setting 703 and/or delay setting 705 as a gain set input 703 to the preamplifier 702 and/or a delay set input 705 to the delay circuit 704.

An Inter-Integrated Circuit protocol (I2C) may be used to transmit, decode, and process gain set 703 and delay set 705 signals over the control channel 725 and by the receiver 720. Other protocols may also be used in other embodiments.

Figure 8:
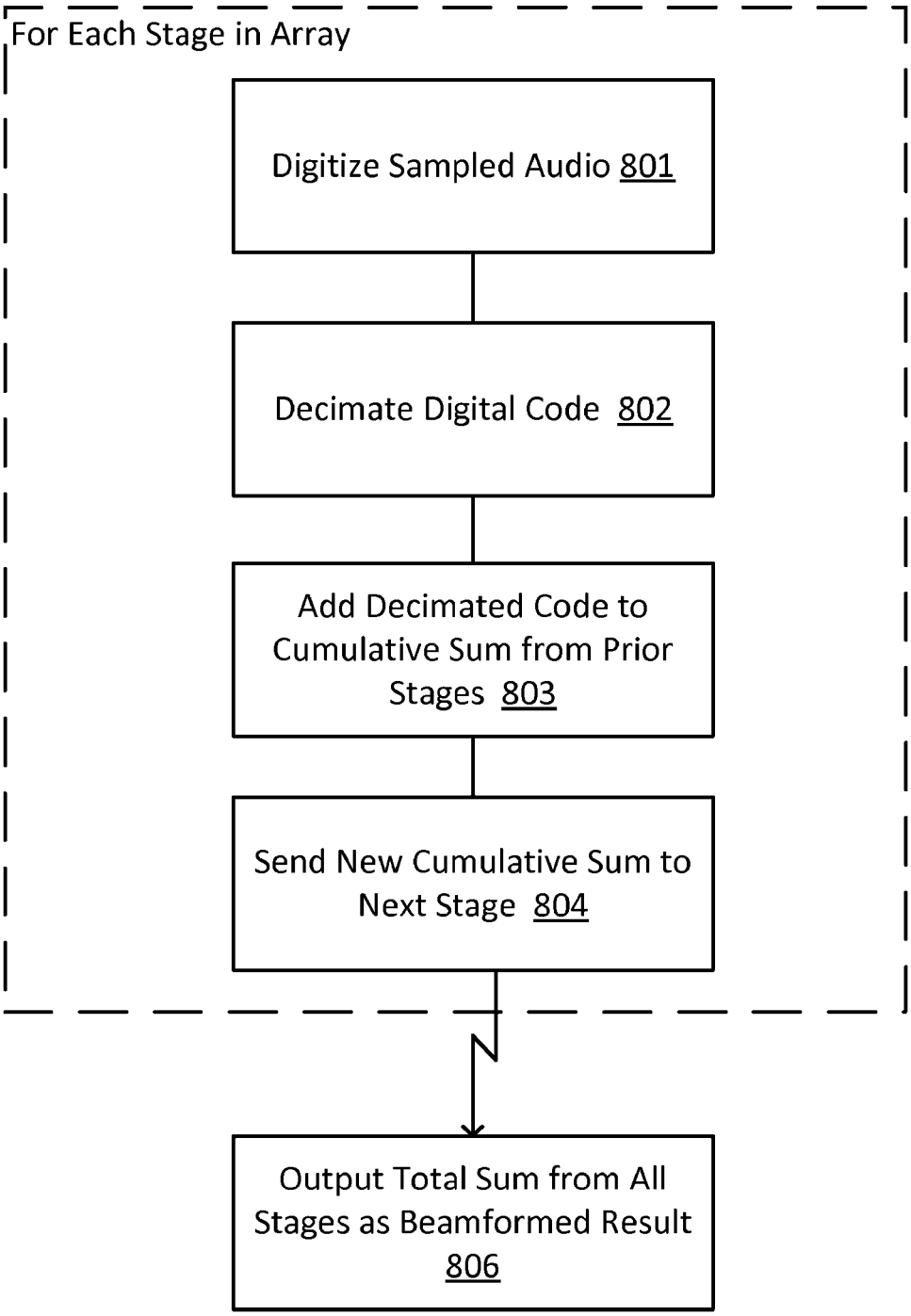
FIG. 8 shows an exemplary process in an embodiment.

FIG. 8 shows an exemplary process in an embodiment of the invention. Boxes 801 to 804 may occur in each microphone stage within a microphone array.

In box 801, audio sampled from a microphone may be converted to digital codes. An analog to digital converter may converted the analog audio signals from the microphone into digital codes. The converter may sample the analog audio signals at higher frequencies than may be used to transmit audio data between microphone stages.

In box 802, a subset of the digital codes may be selected. During the code selection process a delay may be implemented to ensure that the decimator output codes at each stage correspond to codes at the other stages from similar audio signals arriving at different times at the microphones of the other stages. The digital codes may also be decimated to a rate corresponding to the frequency used to transmit audio data between microphone stages.

In box 803, the decimated digital output code from the current stage may be added to a cumulative sum of digital audio codes from prior microphone stages.

In box 804, the resulting sum of adding the digital code from the current stage to the cumulative sum of digital audio codes from prior microphone stages may be sent to a next microphone stage in the array, where the digital code from the next stage may be added to the cumulative sum, and so on. The process may repeat until the digital codes from each stage in the microphone array have been added to the cumulative sum.

Once the digital codes from each of the stages in the array have been added to the cumulative sum, in box 806 the resulting grand total of the digital codes from each of the stages may be outputted by the microphone array as the final beamformed output code.

Figure 9:
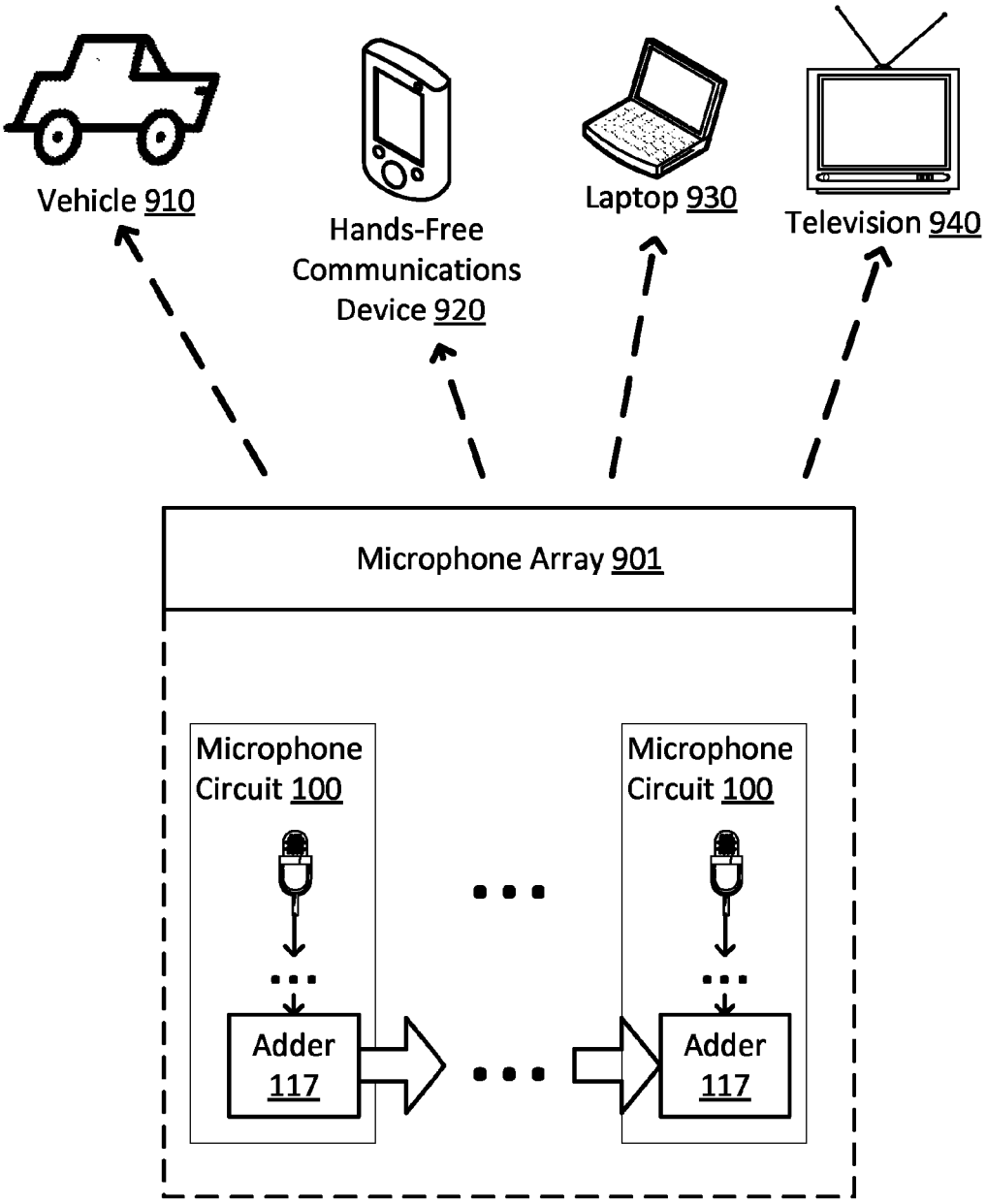
FIG. 9 shows exemplary devices in embodiments.

FIG. 9 shows an exemplary devices in embodiments of the invention. For example, microphone arrays 901 including several daisy chained microphone circuits 100 as previously discussed may be embedded in vehicles 910, hands-free communication devices 920, laptops and other computers 930, and televisions 940, among other devices. In these devices, the microphone arrays may create a beamformed output to reduce the effects of ambient noises, such as vehicle engine sounds, third party conversations, background sounds, and other unwanted noise when communicating in a hands-free mode.

Figure 10:
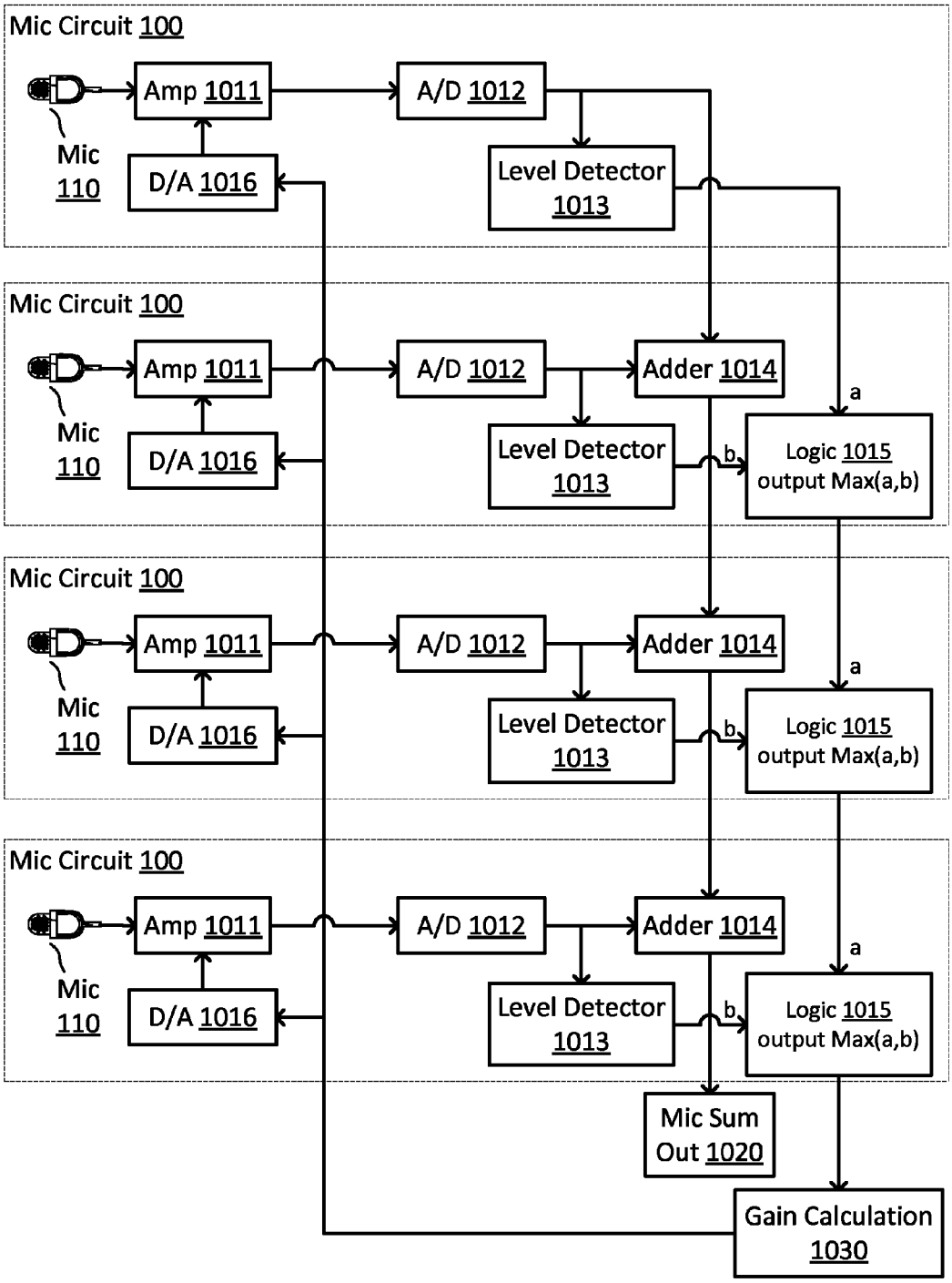
FIG. 10 shows an embodiment in which a highest peak level of each microphone in the array is determined and then used to set the gain for each of the microphones in the array.

FIG. 10 shows an embodiment in which a highest peak level of each microphone in the array is determined and then used to set the gain for each of the microphones in the array. Four microphone circuit stages 100 are shown in this exemplary array, though different numbers of stages may be used in different embodiments.

An input of a variable amplifier 1011 may be coupled to each microphone 110 in each microphone circuit stage 100. The output of the variable amplifier 1011 may be coupled to an analog to digital converter 1012, which may convert sampled amplified analog audio signals into digital codes.

The output of the analog to digital converter 1012 may be coupled to both a level detector 1013 and an adder 1014. The adder 1014 may add the digital code generated at a current stage to a sum of codes from prior stages. The resulting total may then be sent to an adder in a next stage 100 to add the digital code from the next stage 100 to the sum of the digital codes from the prior stages, and so on, until a grand total sum of all the digital codes 1020 is outputted at the final stage in the array.

The level detector 1013 may identify an audio level of the audio signal corresponding to the digital code outputted by the analog to digital converter 1012 in each stage 100. The output of the level detector 1013 in each stage may be coupled to a logic circuit 1015. The logic circuit 1015 may also be coupled to a output of a logic circuit from a prior stage 100 or to the output of a level detector 1013 from a prior stage 100.

The logic circuit 1015 may compare the identified audio level from a current stage to that of a prior stage to identify a highest or maximum audio level. The identified highest audio level from the comparison may be then selected and sent on to logic 1015 in a next stage 100. The logic 1015 in the next stage 100 may then compare the identified audio level from the level detector 1013 in the next stage to the previously selected highest audio level to identify a new highest audio level, which may then be selected and sent to the next stage, and so on. At the end of the array, the maximum audio level may be identified.

The output of the last logic circuit 1015 in the last circuit stage 100 may be coupled to a microcontroller. The microcontroller may calculate a subsequent gain 1030 to be applied to each of the variable amplifiers 1011 based on the identified highest audio level. The calculated gain 1030 may then be sent to a gain set input of each variable amplifier 1011 coupled to the microcontroller. A digital to analog converter 1016 may be coupled between the microcontroller and the gain set input of each variable amplifier 1011 to convert the digital output from the microcontroller into an analog gain set signal for the variable amplifier 1011.

Figure 11:
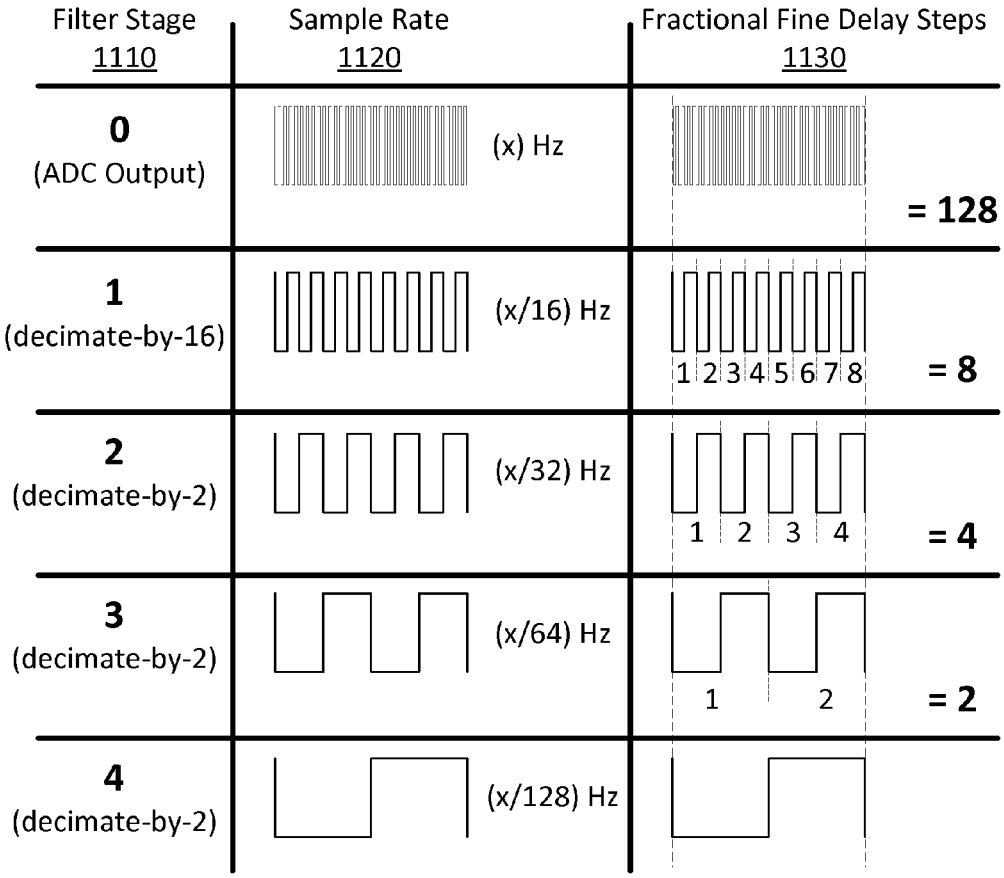
FIG. 11 shows an example of how delay elements may be used between different filter stages during decimation to select a lowest possible sample rate for fine delay steps.

FIG. 11 shows an example of how delay elements may be used between different filter stages during decimation to select a lowest possible sample rate for fine delay steps. Decimation filters may operate in a sequence of successive stages to complete the decimation process. For example a decimation circuit with a decimation factor of 128 may include four filter stages 1110 as shown in FIG. 11.

In this example, the decimation factor indicates that 128 samples of the original ADC output code may cycled through in same time as one sample of the serial data stream. Thus, if the fractional delay is associated with the original ADC output sample rates 1120, it would be possible to select a fractional delay amount in increments of 1/128th the sample rate of the serial data stream.

In the first stage, the sample rate 1120 of the ADC output codes may be decimated by a factor of 16. This may reduce the delay step increments 1130 from 128 to 8, as now only 8 samples may by cycled through in the same time as one sample of the serial data stream. Thus, if the fractional delay is associated with the output of the first stage, it would be possible to select a fractional delay amount in increments of 1/8th the sample rate of the serial data stream.

In the second stage, the sample rate of the output of the first stage may be decimated by a factor of 2. This may reduce the delay step increments 1130 from 8 to 4, as now only 4 samples may by cycled through in the same time as one sample of the serial data stream. Thus, if the fractional delay is associated with the output of the first stage, it would be possible to select a fractional delay amount in increments of 1/4th the sample rate of the serial data stream.

In the third stage, the sample rate of the output of the second stage may be decimated by a factor of 2. This may reduce the delay step increments 1130 from 4 to 2, as now only 2 samples may by cycled through in the same time as one sample of the serial data stream. Thus, if the fractional delay is associated with the output of the first stage, it would be possible to select a fractional delay amount in increments of 1/2th the sample rate of the serial data stream.

In the fourth stage, the sample rate of the output of the third may be decimated by a factor of 2 generating the final desired sample rate of the serial data stream.

Logic may be used to determine which of the filter stages a delay unit should be associated with. The logic may be configured to select the filter stage having a lowest possible sample rate to provide a predetermined minimum fractional step size. For example, if an application requires a fractional delay step size that is at least one third the size of the serial data stream, the delay unit may be coupled to the output of the second filter stage. However, if the application requires a fractional delay step size that is at least one fifth that of the serial data stream, the delay unit may be coupled to the output of the first filter stage, and so on. Providing the ability to select the filter stage having the lowest sample rate may, in some instances, reduce the size of the delay unit and conserve power.

The foregoing description has been presented for purposes of illustration and description. It is not exhaustive and does not limit embodiments of the invention to the precise forms disclosed. Modifications and variations are possible in light of the above teachings or may be acquired from the practicing embodiments consistent with the invention. For example, some of the described embodiments refer to a decimation circuit with a decimation factor of 128 that may include four filter stages, but in other embodiments, different decimation factors and/or numbers of stages may be used.

We claim:

1. A system comprising a plurality of microphone stages arranged in a daisy chained array, each microphone stage in the plurality of microphone stages arranged in the daisy chained array comprising:

an analog to digital converter (ADC) having an input for receiving a microphone signal and outputting a digital code;

a decimation unit having an input for receiving the digital code and for decimating the digital code, producing a decimated digital code, and for outputting the decimated digital code;

a receiver for receiving a first serial data stream including a cumulative sum of decimated digital codes outputted by decimation units of prior microphone stages in the daisy chained array;

a delay unit configured to delay sound from a particular direction represented as the decimated digital code outputted by the decimation unit to time-align with the cumulative sum of the decimated digital codes outputted by the decimation units of the prior microphone stages in the daisy chained array to produce a delayed decimated digital code;

an adder that adds the delayed decimated digital code outputted from the delay unit to the received cumulative sum of the decimated digital codes for producing and outputting an updated cumulative sum that is formed from adding the decimated digital code and the received cumulative sum;

a transmitter for transmitting a second serial data stream including the updated cumulative sum outputted by the adder to a next microphone stage of the plurality of the microphone stages in the daisy chained array; and wherein the delay unit comprises:

a coarse delay unit coupled to the decimation unit and configured to delay the decimated digital code outputted by the decimation unit by a whole number of clock cycles of a serial data stream frame clock used to transmit data between the microphone stages in the dairy chained array; and a fine delay unit coupled to the ADC and configured to delay the digital code outputted from the ADC by a whole number of clock cycles of a ADC clock, wherein a frequency of the ADC clock is higher than a frequency of the serial data stream frame clock, and wherein the second serial data stream transmitted between the microphone stages includes configuration data specifying a delay in a number of clock cycles that each delay unit is to implement, and wherein each of the microphone signal and the cumulative sum represents at least one audio signal.

2. The system of claim 1, further comprising a memory in each microphone stage for storing the configuration data specifying the delay that each respective delay unit in the respective microphone stage is to implement.

3. The system of claim 1, wherein at least one digital code representative of an audio signal and at least one setting in the configuration data are transmitted over a serial interface in a serial interface clock cycle in each of the microphone stages.

4. A microphone interface circuit in a microphone stage receiving output from a microphone array, the microphone interface circuit comprising:

means for delaying by a delay time one of (i) a microphone signal and (ii) a first decimated signal derived from the microphone signal, based on configuration data specifying a number of clock cycles for the delay time, to produce a delayed first signal; and means for generating from the delayed first signal and a second decimated signal a cumulative sum signal wherein the second decimated signal represents at least one audio signal.

5. The microphone interface circuit of claim 4, further comprising:

means for converting an audio signal to the microphone signal by sampling the audio signal.

6. The microphone interface circuit of claim 4, further comprising:

means for decimating the microphone signal and for producing and outputting the first decimated signal;

means for receiving a serial data stream that includes the configuration data and the second decimated signal; and means for transmitting the cumulative sum signal to an other microphone stage in a microphone array.

7. The microphone interface circuit of claim 6, wherein the means for decimating the microphone signal performs decimation at a rate that corresponds to an audio frame rate of the means for receiving the serial data stream and the means for transmitting the cumulative sum signal.

8. The microphone interface circuit of claim 6, further comprising means for filtering, wherein the means for filtering is coupled to the means for decimating the microphone signal.

9. The microphone interface circuit of claim 8, wherein the means for filtering includes one of a finite impulse response (FIR) filter, an infinite impulse response (IIR) filter, and a fast Fourier transform (FFT) circuit.

10. The microphone interface circuit of claim 4, wherein the means for generating includes a means for adding the second decimated signal to the delayed first signal for producing and outputting the cumulative sum signal.

11. The microphone interface circuit of claim 4, wherein the second decimated signal represents a collection of audio signals from at least one other microphone stage in the microphone array.

12. A system comprising a plurality of microphone stages, each of the plurality of microphone stages aligning audio signals each microphone stage in the plurality of microphone stages comprising:

means for delaying by a delay time one of (i) a microphone signal and (ii) a decimated signal derived from the microphone signal, based on configuration data specifying a number of clock cycles for the delay time, to produce a delayed first signal; and means for generating from the delayed first signal and a cumulative sum signal an updated cumulative sum signal, wherein the cumulative sum signal represents at least one audio signal.

13. The system of claim 12, further comprising:

means for controlling gain in each microphone stage;

means for detecting a level in each microphone stage by identifying an audio level of an audio signal from a microphone in a respective microphone stage;

means for identifying a maximum audio level from the identified audio level in each of the microphone stages; and means for calculating a gain setting from the identified maximum audio level across the plurality of microphone stages from the daisy chained microphone array, wherein the calculated gain setting is transmitted to the means for controlling gain in each microphone stage to set a gain.

14. The system of claim 13, further comprising:

means for transmitting the calculated gain setting through the configuration data to a subsequent microphone stage in the plurality of microphone stages.

15. The system of claim 12, further comprising:

means for decimating the microphone signal and for producing and outputting the first decimated signal.

16. The system of claim 15, further comprising means for filtering coupled to the means for decimating the microphone signal, wherein the means for filtering includes one of a finite impulse response (FIR) filter, an infinite impulse response (IIR) filter, and a fast Fourier transform (FFT) circuit.

17. The system of claim 15, wherein the means for delaying delays audio data to time-align the cumulative sum with sound from a particular direction represented as the decimated signal outputted by the means for decimating the microphone signal of a respective microphone stage.

18. The system of claim 12, further comprising:

means for receiving a first serial data stream that includes the configuration data and the cumulative sum signal.

19. The system of claim 18, further comprising:

means for transmitting a second serial data stream including the updated cumulative sum signal to a subsequent microphone stage in the plurality of microphone stages.

20. The system of claim 18, wherein the second serial data stream includes the configuration data, and wherein the configuration data includes microphone address assignment data that assigns an address to each microphone stage in the plurality of microphone stages.

21. The system of claim 12, wherein the means for generating includes a means for adding the cumulative sum signal to the delayed first signal for producing and outputting the updated cumulative sum signal.

22. A microphone interface circuit that time aligns microphone signals from a microphone array, the microphone interface circuit comprising:

a delay unit delaying by a delay time one of (i) a microphone signal and (ii) a first decimated signal derived from the microphone signal, based on configuration data specifying a number of clock cycles for the delay time, to produce a delayed first signal; and a unit for generating from the delayed first signal and a second decimated signal a sum signal, wherein the second decimated signal represents at least one audio signal.

23. The microphone interface circuit of claim 22, further comprising:

an analog to digital converter (ADC) converting an analog audio signal into the microphone signal, wherein the microphone signal is a digital signal.

24. The microphone interface circuit of claim 22, wherein the second decimated signal represents a collection of audio signals from at least one other microphone in the microphone array.

25. The microphone interface circuit of claim 22, further comprising:

a decimation unit for receiving the microphone signal, decimating the microphone signal, and for producing and outputting the first decimated signal;

a receiver for receiving, over a first serial interface, a serial data stream that includes the configuration data and the second decimated signal, and a transmitter for transmitting the sum signal over a second serial interface to an other microphone interface circuit.

26. The microphone interface circuit of claim 25, wherein the unit for generating the sum signal includes an adder for adding the received second decimated signal to the delayed first signal and for producing and outputting the sum signal.

27. The microphone interface circuit of claim 25, wherein the decimation unit decimates the microphone signal at a rate that corresponds to an audio frame rate of the first and the second serial interfaces.

28. The microphone interface circuit of claim 25, further comprising a filter coupled to the decimation unit.

29. The microphone interface circuit of claim 28, wherein the filter is an infinite impulse response (IIR) filter.

30. The microphone interface circuit of claim 28, wherein the filter is a finite impulse response (FIR) filter.

31. The microphone interface circuit of claim 28, wherein the filter is a fast Fourier transform (FFT) circuit.

32. The microphone interface circuit of claim 25, wherein the second decimated signal is a cumulative sum of decimated signals outputted by decimation units upstream in the microphone array from the decimation unit.

33. A microphone circuit that time aligns microphone signals from a first stage of a microphone array with microphone signals from a second stage of the microphone array, the microphone circuit comprising:

the first stage, the first stage providing one of a first microphone signal and a first decimated signal that is derived from the first microphone signal;

the second stage, the second stage providing one of a second microphone signal and a second decimated signal that is derived from the second microphone signal;

a delay unit, the delay unit delaying by a time delay one of (i) the second microphone signal and (ii) the second decimated signal, based on configuration data specifying a number of clock cycles for the delay time, to produce a delayed second signal; and a unit for generating from the delayed second signal and one of the first microphone signal and the first decimated signal a sum signal, wherein each of the first microphone signal and the first decimated microphone signal represents at least one audio signal.

34. The microphone circuit of claim 33, wherein:

the first stage includes a first decimation unit that receives the first microphone signal, decimates the first microphone signal to produce the first decimated signal, and outputs the first decimated signal, and the second stage includes a second decimation unit that receives the second microphone signal, decimates the second microphone signal to produce to the second decimated signal, and outputs the second decimated signal.

35. The microphone circuit of claim 33, further comprising:

a receiver that receives a serial data stream of data including one of the first microphone signal and the first decimated signal, an adder that adds either the received first decimated signal and the second decimated signal or the received first microphone signal and the second microphone signal and outputs the sum signal, and a transmitter that transmits the sum signal to a third stage of the microphone array.

36. A system comprising a plurality of microphone stages, each of the plurality of microphone stages aligning audio signals collected from across a microphone array, each microphone stage comprising:

a delay unit that delays, by a delay time, one of (i) a microphone signal and (ii) a decimated signal derived from the microphone signal, based on configuration data specifying a number of clock cycles for the delay time, to produce a delayed first signal; and a unit for generating from the delayed first signal and a cumulative sum of decimated signals signal an updated cumulative sum signal, wherein the cumulative sum of decimated signals signal represents at least one audio signal.

37. The system of claim 36, wherein the configuration data indicates the number of clock cycles by which one of the microphone signal and the first decimated signal is delayed in each of the microphone stages to time-align sound from a particular direction represented as the decimated signal outputted by the decimation unit of a respective microphone stage with the cumulative sum signal.

38. The system of claim 36, further comprising:

a gain unit in each microphone stage;

a level detector in each microphone stage identifying an audio level of an audio signal from a microphone in a respective microphone stage;

a logic circuit configured to identify a maximum audio level from the identified audio level in each of the microphone stages; and a gain calculation unit calculating a gain setting from the identified maximum audio level for the gain unit in the microphone stages, wherein the calculated gain setting is transmitted to the gain unit in each microphone stage to set a gain of that gain unit.

39. The system of claim 38, wherein the calculated gain setting is transmitted through configuration data to a subsequent microphone stage in the plurality of microphone stages.

40. The system of claim 38, wherein the calculated gain setting is transmitted to each gain unit to set a gain of each respective gain unit.

41. The system of claim 36, wherein the cumulative sum of decimated signals signal represents a collection of audio signals from a subset of the plurality of microphone stages in the daisy chained microphone array.

42. The system of claim 36, further comprising:

a decimation unit that receives the microphone signal, decimates the microphone signal to produce the decimated signal, and that outputs the decimated signal, a receiver that receives a first serial data stream that includes the cumulative sum of decimated signals signal and the configuration data, and a transmitter that transmits a second serial data stream including the updated cumulative sum signal to a subsequent microphone stage in the microphone array.

43. The system of claim 42, further comprising:

an analog to digital converter (ADC), in each microphone stage, receiving an audio signal from a microphone in a respective microphone stage that converts the audio signal to the microphone signal and that transmits the microphone signal to the decimation unit.

44. The system of claim 42, further comprising a filter coupled to the decimation unit in at least one microphone stage.

45. The system of claim 44, wherein the filter is an infinite impulse response (IIR) filter.

46. The system of claim 44, wherein the filter is a finite impulse response (FIR) filter.

47. The system of claim 44, wherein the filter is a fast Fourier transform (FFT) circuit.

48. The system of claim 42, wherein the configuration data is included in the second serial data stream, and wherein the configuration data includes microphone address assignment data that assigns an address to each microphone stage in the array.

49. The system of claim 48, wherein an Integrated Interchip Sound protocol (I2S) is used to transmit data in the first and the second serial data streams.

50. The system of claim 42, wherein the configuration data specifies that the number of clock cycles by which one of the microphone signal and the decimated signal is delayed is to be implemented by at least one of:

a coarse delay unit coupled to the decimation unit and capable of delaying the decimated signal by a whole number of clock cycles of a serial data stream frame clock used to transmit data; and a fine delay unit for delaying the microphone signal and coupled to an ADC, the fine delay unit delaying the microphone signal by a whole number of clock cycles of a ADC clock, wherein a frequency of the ADC clock is higher than a frequency of the serial data stream frame clock.

51. The system of claim 50, wherein the frequency of the ADC clock is at least 2.4 MHz and the serial data stream frame clock frequency is about 44 kHz.

52. The system of claim 42, wherein the decimation unit in each microphone stage downsamples the microphone signal.

53. The system of claim 52, wherein the decimation unit in each microphone stage filters the microphone signal in filter stages before completion of the downsampling of the microphone signal.

54. The system of claim 42, wherein the unit for generating the updated cumulative sum signal includes an adder that adds the received cumulative sum and the decimated signal and that produces and outputs the updated cumulative sum signal.

55. The system of claim 54, wherein:

the configuration data is included in the second serial data stream, and wherein the configuration data includes microphone address assignment data that assigns an address to each microphone stage in the array, and the adder, in each of the microphone stages, increments a microphone address assignment in the microphone address assignment data, and wherein the transmitter transmits the incremented microphone address assignment.

56. The system of claim 55, further comprising a memory in each microphone stage for storing a respective microphone address assignment assigned to the respective microphone stage.

57. The system of claim 55, wherein at least one microphone signal representative of an audio signal and at least one setting in the configuration data are transmitted by the transmitter in a serial interface clock cycle.

58. A method to align audio signals that are collected from two different microphone stages connected by a serial interface in a microphone array, the method comprising:

decimating a microphone signal at a rate that corresponds to an audio frame rate of the serial interface to generate a decimated signal;

receiving, at the serial interface, a serial data stream including:

a cumulative sum of decimated digital signals, and configuration data specifying a number of clock cycles by which one of the microphone signal and the first decimated signal is delayed to produce a delayed decimated signal;

adding the delayed decimated signal to the cumulative sum to generate a new cumulative sum; and transmitting, over the serial interface, the new cumulative sum, wherein the cumulative sum of decimated digital signals represents at least one audio signal.

59. The method of claim 58, further comprising:

converting an analog audio signal from a microphone in an array of microphones into the microphone signal, wherein the microphone signal is a digital signal.

60. The method of claim 58, wherein the decimated digital signals forming the cumulative sum represent an audio signal from other microphone signals in the microphone array.

61. The method of claim 58, further comprising:

repeating the method of claim 58 for each microphone in the microphone array; and outputting a final cumulative sum of decimated codes instead of the new cumulative sum at a last microphone in the microphone array as a beamformed result.

62. The method of claim 58, wherein the delaying of the microphone signal is performed until an audio signal represented in the microphone signal is time aligned with an audio signal represented in the cumulative sum, and wherein the cumulative sum of decimated signals includes microphone signals from any prior microphones in the array.

63. The method of claim 62, wherein the delaying of the microphone signal includes initially delaying the microphone signal before the decimating and then delaying the microphone signal again after the decimating.

* * * * *